United States Patent [19]

Schips

[11] 4,262,612

[45] Apr. 21, 1981

[54] LABEL INSERTING DEVICE FOR SEWING MACHINES

[76] Inventor: Helmut Schips, Steinacherstrasse 340, 9327 Tubach, Switzerland

[21] Appl. No.: 911,118

[22] Filed: May 31, 1978

[30] Foreign Application Priority Data

Jun. 2, 1977 [CH] Switzerland ..... 6825/77

[51] Int. Cl.[3] ..... D05B 35/06

[52] U.S. Cl. ..... 112/114

[58] Field of Search ..... 112/114, 112, 105, 115, 112/265.1, 104, 121.22, 253, 311, 88, 121.12

[56] References Cited

U.S. PATENT DOCUMENTS

| | | | |
|---|---|---|---|
| 328,298 | 10/1885 | De Beaumont | 112/115 |
| 2,374,043 | 4/1945 | Simmons et al. | 112/112 |
| 3,669,043 | 6/1972 | Nicolay | 112/114 X |
| 3,954,071 | 5/1976 | Mall et al. | 112/207 |
| 4,029,032 | 6/1977 | Medynski et al. | 112/121.22 |

FOREIGN PATENT DOCUMENTS

| | | | |
|---|---|---|---|
| 1955796 | 5/1971 | Fed. Rep. of Germany | 112/104 |

*Primary Examiner*—Werner H. Schroeder
*Assistant Examiner*—Andrew M. Falik

[57] ABSTRACT

Sewing labels on a sewing machine having a label feed attachment is provided by a pair of clamp members. The clamp members are pivotably joined at one end to open and close at the other end and are conjointly movable in a path parallel to the path of movement of the material from a first position corresponding to the point at which the labels enter the path of movement of the material to a second position corresponding to the mouth of said presser foot. The labels are grasped and moved by the clamp members into contact with said material and held thereto by a cooperating feed mechanism and presser foot for sewing.

10 Claims, 9 Drawing Figures

LABEL INSERTING DEVICE FOR SEWING MACHINES

BACKGROUND OF THE INVENTION

The present invention relates to a label positioning device for sewing machines and more particularly to such a device for sewing labels on the blind or underside of the material.

It is known for example, from U.S. Pat. No. 2,374,043 or German Patent Publication No. 1955796 that in the sewing of labels on a material, e.g. a garment, the label is brought by hand or automatically into the vicinity of the stitching elements of a sewing machine, in order to be joined to the material. The actual feeding process however, which positions the label between such stitching elements, i.e. the feed drive and needle, and the presser foot in order to be included in the seam produced by the sewing machine, has heretofore been effected manually, i.e. by the seamstress. This requires interruption of the sewing process, and a general slowdown of the overall sewing operation to enable the seamstress to position the label firstly at the given point and secondly as straight as possible relative to the intended seam. This becomes especially difficult when the label is to be sewn on the blind or underside of the material since the operator's view of the label is obstructed by the overlying fabric.

Prior attempts at positioning the label beneath the material so as to avoid interruption of the sewing process, locate the label at the desired point, and position the label straight with respect to the seam to the extent possible, have, as far as is known, been unsuccessful to date.

It is the principal object of the invention to provide a device for the correct positioning of a label for sewing onto a fabric material in order to achieve higher output and improved quality in the application of such labels.

Another object of the invention is to provide a label positioning device which will improve the uniformity with which labels are stitched to garments without slowing down the sewing operation.

Other objects and advantages of the invention will become readily apparent to persons versed in the art from the ensuing description.

BRIEF DESCRIPTION OF THE DRAWINGS

In order that the invention may be more fully comprehended it will now be described, by way of example, with reference to the accompanying drawing in which.

DESCRIPTION OF THE INVENTION

Figure 1:
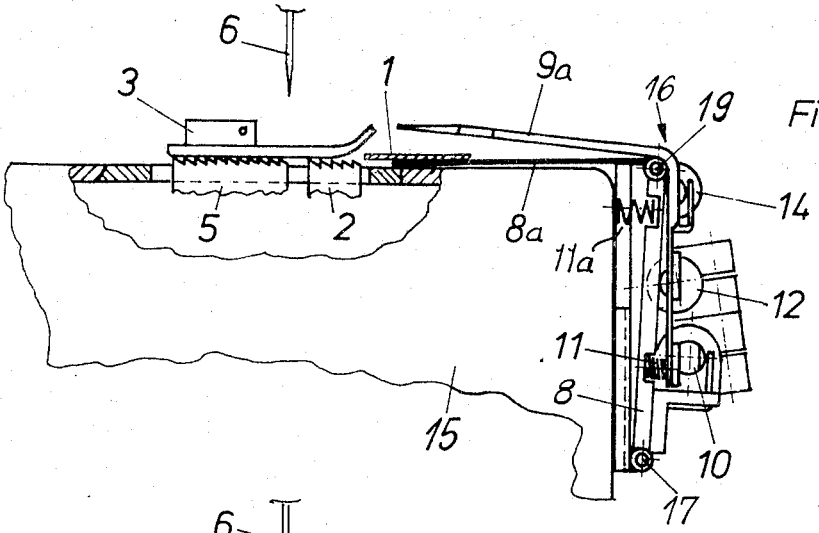
FIG. 1 is a side elevation view of the front section of a sewing machine with a label positioning device embodying the features of the invention thereon having its clamp opened for introduction of the label, the sewing elements being shown partly in section.
Figure 2:
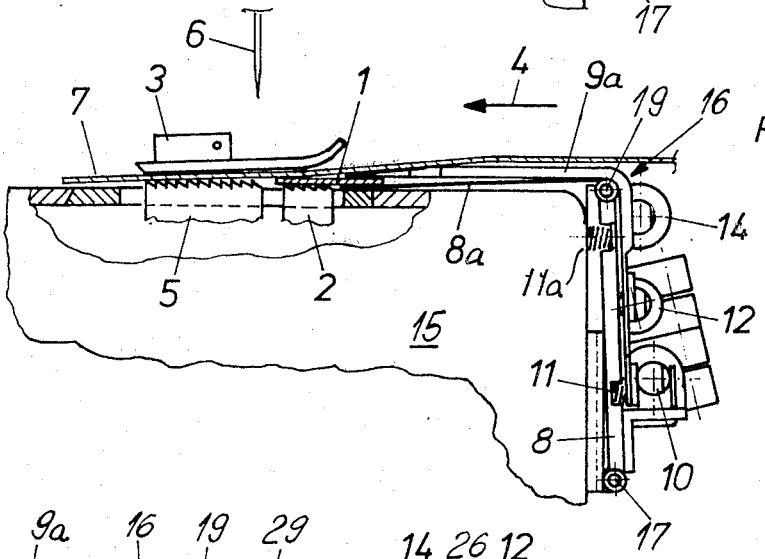
FIG. 2 is a view similar to that of FIG. 1, with the clamp closed and in label positioning location.
Figure 3:
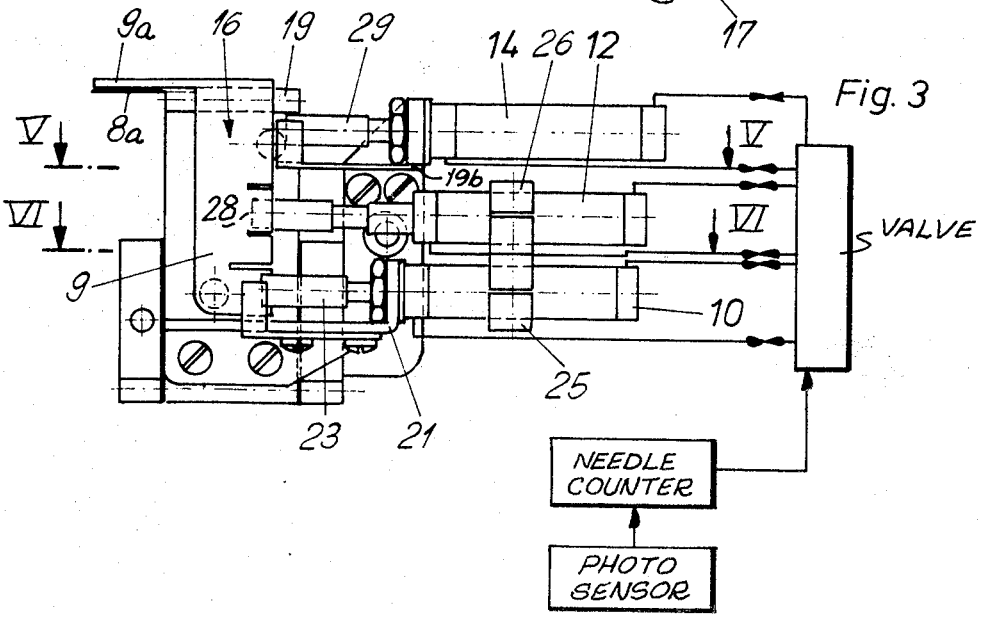
FIG. 3 is a front elevation view of the device shown in FIG. 1.

The present invention is applied to conventional sewmachines, illustrated in the drawings as have a table 15 in which is located a material feed comprising a cogged member 5 and a differential cogged member 2 both reciprocable in conventional rectangular motion to feed a fabric 7 beneath a presser foot 3 from right to left as shown by arrow 4 in FIG. 2. Located above the presser foot 3 is one or more needles 6. Operation of the needle 6, presser foot 3, and feeds 2 and 5 can be made conventionally to provide any selected stitch. The machine is provided with a conventional label feed mechanism adapted to feed a label 1 at right angles to movement of the fabric into the presser foot 3, e.g. perpendicular to the plane of the drawings, until such time as it can be engaged by the fabric 7 and conjointly moved with it. The label is supplied in such a way that its front edge is disposed in front and adjacent to the gripping point of differential feed 2 and beneath the upturned edge of the pressure foot 3. The label is located a sufficient distance to the right (FIG. 1) such that it will be engaged and stitched to the material 7 by the needle 6. For purposes of clarity only one ply of material and a single label 1 are shown. Depending upon the type of sewing machine and its attachments, different seam patterns are possible to stitch the label and the material together.

To insure proper positioning of the label 1 and its proper engagement with the fabric, a clamp assembly, generally depicted by numeral 16, is mounted on the front end of the stationary table, in line with the material feed. The clamp assembly comprises a support bracket 8 pivotably mounted on its lower end by an axle 17 mounted on the front skirt of table 15. The bracket extends upwardly and is formed with a blade 8*a*extending at a generally right angle normal to the bracket 8. The blade 8*a* extends over the surface of the table top which is formed so as to permit the blade or tong 8*a* to extend below the label 1 as it is fed and toward the presser foot 3. Pivotably mounted on an axle 19 secured at the upper end of bracket 8 is flat spring-like member 9. The member 9 is bent to have one leg to extend parallel to the blade 8*a*, at the end of which is formed a clamp or tong member 9*a* which overlies the tip end of the blade 8*a* and to have a depending leg which extends the length of the bracket 8. Located between the bracket 8 and the depending leg of member 9 is a compression spring 11 which normally biases the member 9 to the right simultaneously causing the end of its clamp member 9*a* to be biased downwardly into clamping position with the blade 8*a*.

Mounted between the skirt of the table 15 and the bracket 8 is a second spring 11*a* which normally biases the bracket 8 outwardly (to the right) from the table 15. This causes the blade 8*a* to be normally slid to the right away from the presser foot 3. Thus, the blade 8*a* is not pivotal with respect to the bracket 8 but has a flat planar reciprocating movement.

Mounted to the rear (as seen in FIG. 1 & 2) of the clamp assembly 16, and in ascending relationship are three compressed air cylinders and pistons, 10, 12, and 14, respectively. Each of these cylinders and pistons are arranged parallel to each other and have their pistons extending toward the clamp assembly 16, as seen in FIGS. 3–6. At the end of the pistons of each of cylinder and pistons 10, 12 and 14 respectively are wedged shape members 23, 28 and 29. The wedge members 23 and 29 have their sloping edge facing the sewing table, while the wedge 28 has its sloping edge facing away from the sewing table.

Figure 6:
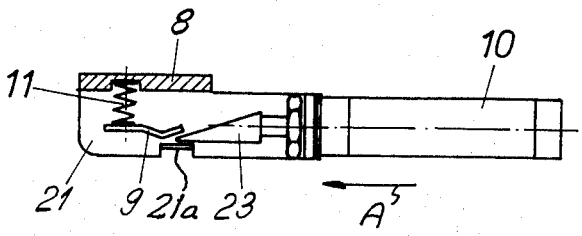
FIG. 6 is a fragmentary top plan view taken along line VI—VI of FIG. 3.

Further, the lower most cylinder 10 is placed so that its associated wedge 23 will ride against the bottom edge of the member 9 which is crenelated as seen in FIG. 6, causing the member 9 to move inwardly against the spring 11. To insure that the wedge 23 moves positively against the member 9, a bracket 21 is provided at the bottom of the bracket 8 having a small wall 21 a which abuts against the rear face of the wedge 23.

Figure 5:
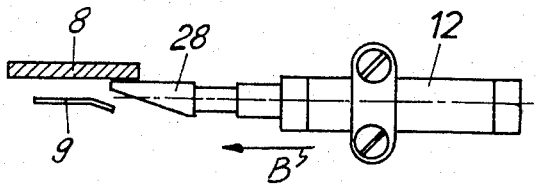
FIG. 5 is a fragmentary top plan view taken along line V—V of FIG. 3.

The intermediate cylinder 12 is arranged so that its wedge moves between the bracket 8 and the depending portion of the member 9, as seen in FIG. 5.

Figure 4:
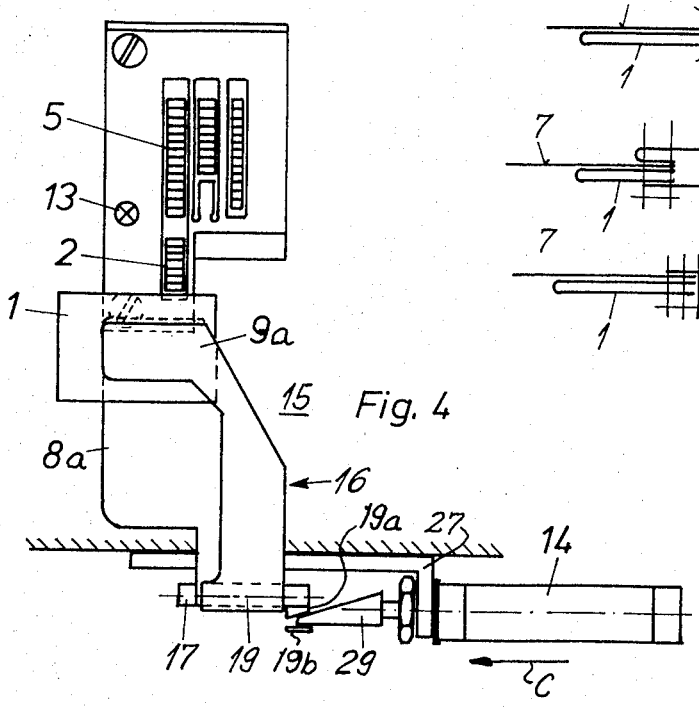
FIG. 4 is a top plan view of the device shown in FIG. 1.
Figure 7:
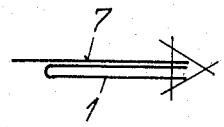
FIGS. 7 to 9 show three possible seam patterns for stitching the label to the fabric.
Figure 8:
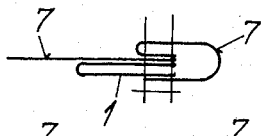
Figure 9:
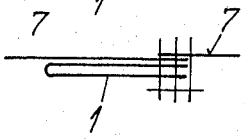

The uppermost cylinder 14 is arranged so that its wedge 29 moves to the left and rides against the upper end of the bracket 8 substantially at the pivot axle 19. To insure proper alignment of the wedge 29, the pivot axle 19, as seen clearly in FIG. 4 is provided with a counter wedge 19*a* and a rear stop 19*b* secured to the mount 16 for the clamp assembly. Movement of the wedge 29 causes the entire bracket 8 to move against spring 11*a* inwardly to the left from the position shown in FIG. 1 to that of FIG. 2.

The bracket 21 extends with a collar about the lower cylinder 10 securing it to the bracket 8, while the cylinders 10 & 12 are held together by strap means 25 & 26. The upper cylinder 14 is secured to the table by a bracket 27.

In operation, the label 1, supplied to the sewing machine, is introduced between clamp member 8*a* and the other clamp 9*a*. In order to accommodate the label, leg 9 of clamp 16 is opened by means of cylinder assembly 10, moving the wedge in the direction A, shown in FIG. 6. The member 9 is thus provided clockwise about its pivot member 19, against the biasing force of spring 11. The label to be sewn on is then supplied and is supported on the upper surface of the clamp member 8*a* after which the wedge 23 is retracted and clamp member 9*a* automatically closes on the clamp member 8*a* as a result of the influence of the spring 11. Spring 11 retains the label 1 in position on clamp plate 8*a* in a moderately firm manner by this biasing force.

Actuation of cylinder assembly 12 in the direction of arrow B as shown in FIG. 5, causes the clamp arm 9*a* to be pressed into closer engagement with the label 1 on clamp plate 8*a*, by causing the lower end of the member 9 to bow outwardly from bracket 8 causing a bell crank effect on clamp arm 9*a*. The pressure is such that as the material 7 slides over the label 1 during sewing, neither the material nor the other external influences of the feed will affect the desired position of the label 1.

The material is then fed toward the needle until such time as its front edge is sensed by a control element 13 such as a photo cell, diode, or similar sensor, and a signal is generated which activates a counter which measures the distance of movement of the material 7 by the number of stitches sewn and, after a preselected number (which establishes the position of the label, with respect to the front edge of the material) generates a signal conventional valve means associated with the air and cylinder pistons for insertion of the label into the operative zone of the feeds 2 and 5 by advance of clamp 16, toward the table 15, i.e. in the direction of arrow 4 by operation of the upper cylinder 14 moving the wedge 29 in the direction of arrow C.

Release of the clamping pressure permitting insertion of the label 1 for the sewing operation is effected by cylinder 12. Actuation of cylinder 14 applies moderate pressure on clamp plate 8 to advance it together with label 1 into the operative zone of the feeds 2 and 5. Wedge 29 when actuated thus shifts the entire clamp 16 including the label 1 into operative relatinship with the feeds 2, 5, clamp 16 as a whole being pivoted about its bearing pin 17 (FIG. 2.) Feed 2 withdraws the label 1 from the clamp member 8*a* & 9*a* which is closed only under pressure of spring 11. This pressure is sufficient to insure that label 1 cannot be rotated from its proper position or shifted with respect to the material. When label 1 has been seized by feed 2 to the extent that it is retained beneath presser foot 3, the cylinder 10 is once again actuated to shift its piston and wedge 23 so as to open the clamp members 8*a* and 9*a*. The compressed air cylinder assembly 14 then is deactivated to effect the return movement of clamp assembly 16 about pivot 17. The timing or moment of the opening and pivoting back of the clamp 16 assembly is adjustable, in order that labels of different widths can be processed.

The cylinder assemblies 10, 12, & 14 are preferably activated by compressed air, although hydraulic cylinder assemblies may be employed. Compressed air may be bottled although most sewing machine plants or factories have a normal line supply of compressed air for other uses which may be used here. The cylinders are preferably double acting to insure accurate, prompt response although single acting spring biased units may be used. Control of the cylinders may be easily made through the use of conventional valves, relay timers, sensing devices and solenoid controls.

When the material to which label 1 is to be sewn is elastic material, as for example knit goods, it is important to give the differential feed 2 a greater stroke than that of the main feed 5. Adjustment of the sewing machine drive in this manner for elastic material, avoids unintended displacement or folding of the label. Alternatively, the differential feed may be disconnected by a known device not shown, the so-called differential rapid adjustment. The differential feed 2 then operates with the same stroke as the main feed 5.

From the foregoing it will be seen that a label positioning device has been provided which obviates the need for manual placement of the label relative to the material on which the label is to be sewn thereby enabling attainment of the objective heretofore stated.

I claim:

1. In a sewing machine having a feed mechanism for feeding in a given path material to be sewn, a presser foot arranged in opposition to said feed mechanism and cooperating therewith to provide a mouth for said material and to hold said material during sewing and a label feed for providing labels in a direction perpendicular to the feed of the material and a point within the path of said material feed in advance of said presser foot, clamp means for insuring the proper sewing of labels to the underside of said material comprising a pair of tongs arranged one above the other, the lower tong being arranged to reciprocate in a plane below the mouth of said presser foot, the upper tong being pivotably mounted to said lower tong to swing with respect to it and conjointly move with it in a path parallel to the path of movement of said material from a first position corresponding to the point at which said labels enter the path of movement of said material to a second position corresponding to the mouth of said presser foot whereby said labels may be grapsed and moved by said clamp means into contact with said material and held thereto by the cooperating feed mechanism and presser foot.

2. The attachment according to claim 1, including means for cyclically operating said clamp means to repetitively feed a succession of said labels in conjunction with said material.

3. The attachment according to claim 1, wherein said tongs comprise first and second angle members each formed by a first and a second connected generally perpendicularly extending leg elements, said angle members being pivotably connected each other adjacent the intersection of their respective leg elements, so that said first leg element and said second leg element of both angle members extend in the same direction, a first leg element of the first of said angle members being resiliently biased with respect to the first leg element of the second angle member and said first leg element of said second angle member being adapted for pivotable mounting to the sewing machine, whereby the second leg elements of said leg members are cooperable to form releasable clamp jaws receiving and holding the label to be sewn, movable as a unitary assembly, first motive means for moving the first leg element of said first angle member toward and away from the first leg element of said second angle member to thereby open and close the jaws of the clamp, second motive means acting on said first leg elements of both said angle members for increasing the closing pressure of the jaws of the clamp, and third motive means for pivoting said leg members as a unitary assembly, to advance the clamp jaws towards the sewing elements of the sewing machine.

4. The attachment according to claim 3, including means for operating said first, second, and third motive means in a cyclical repetitively timed sequence whereby said first motive means causes opening of said clamp jaws for reception of a label therein, then closing of said clamp jaws to hold said lable, thereafter said second motive means increases the pressure thereof to permit transfer of said label simultaneously with the operation of said third motive means to move said clamp and label to the sewing element.

5. An attachment according to claim 3, including means for sensing the presence and length of material fed to the sewing elements of the sewing machine and for generating a signal to initiate operation of said motive means.

6. An attachment according to claim 5, wherein said sensing means includes a photoelectrical cell.

7. The attachment according to claim 4, including means for regulating the sequential operation of said motive means in response to a predetermined length of material and/or label being sewn.

8. An attachment according to claim 4, including spring means for resiliently connecting said first leg elements.

9. An attachment according to claim 4, wherein said first and second means comprise compressed air cylinders each having reciprocable pistons and wedge members movable so as to be cooperable with said first leg elements, said first and second means being carried by said first leg element of said other leg member.

10. An attachment according to claim 9, wherein said third means comprises a compressed air cylinder carried on a sewing machine and includes a piston and wedge member movable to be cooperable with said leg members to pivot same as a unitary assembly between said first advanced position and second retracted position.

* * * * *